United States Patent [19]

Pease et al.

[11] Patent Number: 4,509,448

[45] Date of Patent: Apr. 9, 1985

[54] QUICK DISCONNECT/CONNECT MOORING METHOD AND APPARATUS FOR A TURRET MOORED DRILLSHIP

[75] Inventors: Floyd T. Pease; Joseph T. Shelton, both of Houston, Tex.

[73] Assignee: Sonat Offshore Drilling Inc., Houston, Tex.

[21] Appl. No.: 541,539

[22] Filed: Oct. 13, 1983

[51] Int. Cl.[3] ..... B63B 21/50

[52] U.S. Cl. ..... 114/293; 114/230

[58] Field of Search ..... 114/230, 293, 294; 441/3-5

[56] References Cited

U.S. PATENT DOCUMENTS 2,986,888 6/1961 Borrmann et al. ..... 114/293 X
3,279,404 10/1966 Richardson ..... 441/3 X
3,703,151 11/1972 Clement ..... 114/230

FOREIGN PATENT DOCUMENTS 2151597 4/1973 Fed. Rep. of Germany ..... 114/230
598037 2/1948 United Kingdom ..... 114/230

*Primary Examiner*—Sherman D. Basinger
*Attorney, Agent, or Firm*—Bradford E. Kile; Kevin M. O'Brien

[57] ABSTRACT

A disconnect/connect mooring system for a turret moored drillship is disclosed including an anchor, a first mooring line connected at one end to the anchor, including a length of wire rope and a mooring line chain, a submersible buoy connected to the mooring line chain and a second mooring line connected to the buoy chain and extending to the turret moored drillship.

20 Claims, 24 Drawing Figures

ON LOCATION

PREPAIRING FOR DISCONNECT

DISCONNECTED SYSTEM
( VESSEL MOBILIZE AWAY
FROM TYPHOON )

RECONNECTION AT SITE

RESUMPTION OF DRILLING
WITH FULL MOORING

QUICK DISCONNECT/CONNECT MOORING METHOD AND APPARATUS FOR A TURRET MOORED DRILLSHIP

BACKGROUND OF THE INVENTION

This invention relates to a method and apparatus for quickly disconnecting/connecting a mooring system for a turret moored drillship.

In the past, demand for a working platform around and upon the slope and continental shelf regions of the world has substantially increased with advances in technical capability. Examples of fixed station offshore facilities include supports for radar stations, light beacons, scientific and exploration laboratories, chemical plants, power generating plants, mining stations, etc. Principally, however, offshore facilities have been utilized by the oil and gas industry in connection with drilling, production, and/or distribution operations.

In shallow water applications, such as the nearshore portions of the Gulf of Mexico, fixed towers or platforms have been extensively utilized. In this regard, such offshore towers are typically fabricated onshore and transported in a generally horizontal posture to an offshore site upon a barge or buoyancy chambers within the tower legs. On site, the tower is pivoted into an upright posture and the base is positioned into secure engagement with the seabed. A platform deck is then fabricated upon the erected tower for conducting offshore operations. Such fixed platforms, although relatively economical, require considerable time to assemble and once in position are difficult to relocate.

One design which enhances the ability of a platform to be brought on station, operated, and then removed to a differing working site is known as a "jack-up platform". A jack-up platform typically comprises a barge or self-propelled deck operable to function in a conventional flotation capacity during transportation and in a working deck capacity on location. The deck carries a plurality of legs which are jacked downwardly from the deck into the seabed until the deck is raised a suitable working distance above a statistical storm wave height. Upon completion of desired operations, the deck is lowered down to the surface of the body of water and the legs are jacked back up to the deck. The platform is then towed or navigated to another working station where the process is repeated. Although jack-up platforms exhibit enhanced mobility, it will be recognized that jack-ups have depth limitation and for that reason are not always capable of being utilized in desired locations on the shelf.

In deep water applications, semi-submersibles or drillships are most often utilized. A drillship is constructed with a well opening, or moon pool, and the vessel is moored at a preselected site and/or dynamically positioned by thrusters. Drilling operations are conducted from the drillship through the moon pool. Of the presently known drillship designs it has been found that a turret moored drillship, such as disclosed in Richardson et al., U.S. Pat. No. 3,191,201 or Richardson U.S. Pat. No. 3,279,404 has been particularly effective. The foregoing Richardson et al and Richardson patents are of common assignment with the instant application and the disclosures thereof are incorporated herein by reference as though set forth at length. Briefly, however, a moon pool is fashioned through a central axis of the drillship and a turret is positioned within the moon pool. A set of eight mooring lines are then radially splayed from the turret and tensioned from winches mounted around the mooring turret. Once on station, with the mooring lines secure, the drillship is dynamically rotated about the turret through the utilization of retractable thrusters to maintain the vessel headed into prevailing wind and/or current. Station keeping for such turret moored drillships has been extremely reliable and accurate. Accordingly such drillships are the equipment of choice in deepwater applications.

Although previously known drillships have been advantageously utilized, certain situations occur which make it desirable to temporarily disconnect mooring lines from the turret moored vessel and then reconnect the lines and continue operations. In this connection, it has been found that a hurricane and/or typhoon in various shelf regions of the world may contain winds substantial enough to be potentially damaging to a working vessel. In addition, in polar regions of the world it is possible that a drillship may need to go off station in order to avoid collision from an iceberg. In such situations it has been found that although a drillship has the mobility to avoid environmental forces, rapidly releasing the drillship from its mooring lines can be troubling. Moreover, once an emergency environmental condition has passed it would be highly desirable to quickly reposition and reconnect the mooring lines to the drillship for continued on station operations.

In the past, systems have been at least theorized to disconnect and connect mooring lines to a drillship. In one design a mooring line is separated and fitted at each end with a sparbuoy carrying a remotely controlled disconnect element. Although this system has a degree of conceptual appeal, it is not believed that the operative integrity of the system is sufficient to reliably use the concept with a turret moored drillship.

Another previously known design includes a mooring line having an intermediate explosive link such that the mooring line can be selectively severed to quickly release the drillship. Although explosive links have been known in the past, it is not believed that the reliability of such systems is sufficient to warrant utilization in an environment where an error can produce consequential damages of tremendous magnitude. Moreover, explosive link systems can be difficult to reconnect during subsequent operations.

The difficulties suggested in the proceeding are not intended to be exhaustive, but rather are among many which may tend to reduce the effectiveness and user satisfaction with prior quick-disconnect/connect mooring systems. Other noteworthy problems may also exist; however, those presented above should be sufficient to demonstrate that drillship mooring systems appearing in the past will admit to worthwhile improvement.

OBJECTS OF THE INVENTION

It is therefore a general object of the invention to provide a novel, quick-disconnect mooring system and method which will obviate or minimize difficulties of the type previously described.

It is a specific object of the invention to provide a novel, quick-disconnect/connect mooring system and method which will exhibit a high degree of structural integrity as a mooring system.

It is another object of the invention to provide a novel, quick-disconnect/connect mooring system and method which will admit to reliable operation on location in a remote and hostile environment.

It is yet another object of the invention to provide a novel, quick-disconnect/connect mooring system and method for a turret moored drillship wherein a drillship can be facilely and quickly disconnected from the mooring system to maneuver free of an environmental hazard and then admit to rapid reconnection in order to minimize working downtime of the drillship.

It is a further object of the invention to provide a novel, quick-disconnect/connect mooring system and method for a turret moored drillship wherein reconnection procedures are simplified following passage of an environmental hazard.

It is yet a further object of the invention to provide a novel, quick-disconnect/connect mooring system and method wherein a partial disconnect procedure may be affected to delay a final decision on an environmental dictated disconnect procedure.

It is still yet a further object of the invention to provide a quick tentative disconnect mooring system and method for a turret moored drillship wherein the system may be facilely reconnected in the event environmental conditions do not ultimately dictate removal of the drillship.

BRIEF SUMMARY OF A PREFERRED EMBODIMENT OF THE INVENTION

One preferred embodiment of the invention which is intended to accomplish at least some of the foregoing objects includes a quick-disconnect/connect mooring system for a turret moored drillship wherein each mooring unit includes an anchor for releasably engaging the bed of a body of water, a first mooring line is connected at one end to the anchor and includes a length of wire rope and a mooring chain serially connected to the wire rope. A submersible buoy is operably connected to the mooring chain and a second mooring line is releasably connected between the mooring chain and the drillship.

In an operative posture the submersible buoy is submerged and a first catenary is formed between the anchor and the submerged buoy and a second catenary is formed between the buoy and the turret moored drillship. Upon release of tension on the second mooring line from the drillship the submersible buoy raises to the surface carrying the mooring lines. The second mooring line is then released from the mooring chain and withdrawn to the drillship. The first mooring line remains suspended on station from the floating submersible buoy and operably rides out an environmental hazard while the drillship is navigated to a location sufficiently remote to avoid damage.

THE DRAWINGS

Other objects and advantages of the present invention will become apparent from the following detailed description of preferred embodiments thereof taken in conjunction with the accompanying drawings, wherein.

FIGS. *5a–5f* disclose a schematic sequence of disconnecting a single mooring unit from a turret moored drillship in accordance with the invention;

FIGS. *6a–6f* disclose a sequence of views of connecting a single mooring unit to a turret moored drillship in accordance with the invention; and FIGS. *7a–7h* disclose a schematic sequence of views for disconnecting and reconnecting a mooring system to a turret moored drillship in accordance with a preferred embodiment of the invention.

DETAILED DESCRIPTION

Context of the Invention

Figure 1:
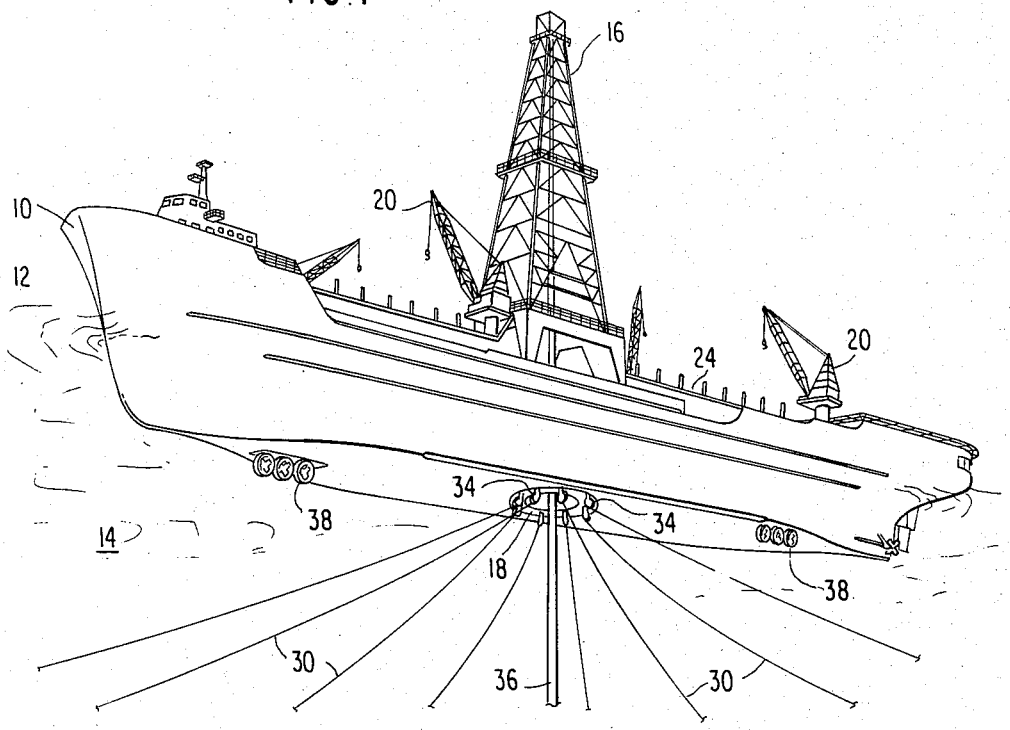
FIG. 1 is an axonometric view of a turret moored drillship securely moored at a working location by a series of mooring units splayed outwardly from a moon pool turret.
Figure 2:
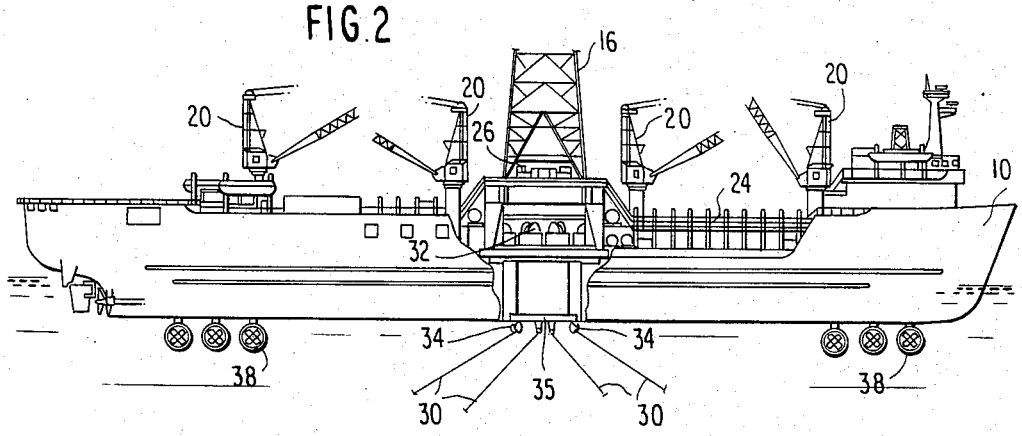
FIG. 2 is a side elevational view of the drillship depicted in FIG. 1 wherein a central moon pool area of the vessel is broken away to disclose a mooring turret, mooring lines and tensioning winches for the mooring lines.

Referring now to the drawings and initially to FIGS. 1 and 2, there will be seen a pictorial representation of a turret moored drillship forming the particular operative environment of the subject invention. More specifically, the drillship 10 is shown floating on the surface 12 of a body of water 14 and includes a centrally mounted derrick 16 positioned over a moon pool 18 extending through the hull of the drillship. As identified most readily with reference to FIG. 2 the drillship is fitted with a usual complement of drilling equipment such as working cranes 20, pipe racks 24, drawworks 26, etc.

The turret mooring character of the drillship is discussed in detail in the above-referenced Richardson U.S. Pat. No. 3,279,404. Briefly, however turret mooring entails a plurality of mooring units 30 (preferably eight in number) which extend longitudinally through the moon pool and are anchored to the waterbed. The mooring units 30 are tensioned by a plurality of winches 32 mounted adjacent the moon pool and each mooring unit 30 passes through fairlead mountings 34 at the base of the mooring turret. The mooring units 30 are uniformly splayed outwardly and downwardly from the mooring turret 35 and serve to maintain the drillship and riser casing 36 substantially in alignment with a subsea drillhole.

In order for the drillship 10 to minimize forces on the mooring lines and maintain accurate stationkeeping, a plurality of retractable thrusters 38 are fitted into the ship's hull and are dynamically operated to maintain the heading of the ship into prevailing wind and/or current forces. It has been found that the foregoing turret moored drillship may be accurately maintained on station even in extremely deepwater drilling operations without rupturing or otherwise damaging the marine riser 36 and any interior tubular column.

Figure 3:
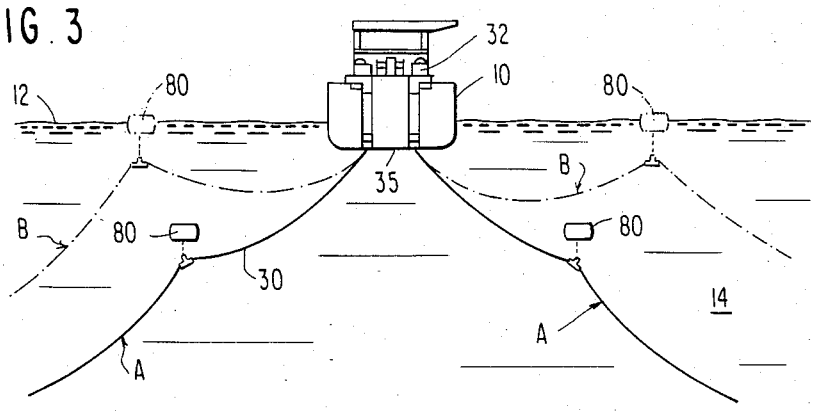
FIG. 3 is a sectional view through the drillship depicted in FIGS. 1 and 2 and discloses the mooring lines for the drillship in a tensioned and a relaxed condition.

Turning to FIG. 3 there will be as seen a schematic sectional view of the drillship 10 with two mooring units 30 in an tensioned or operative mooring mode (A) and as shown in phantom in a relaxed or nonoperative condition ready for a disconnection procedure in accordance with the invention.

Mooring Unit

Figure 4:
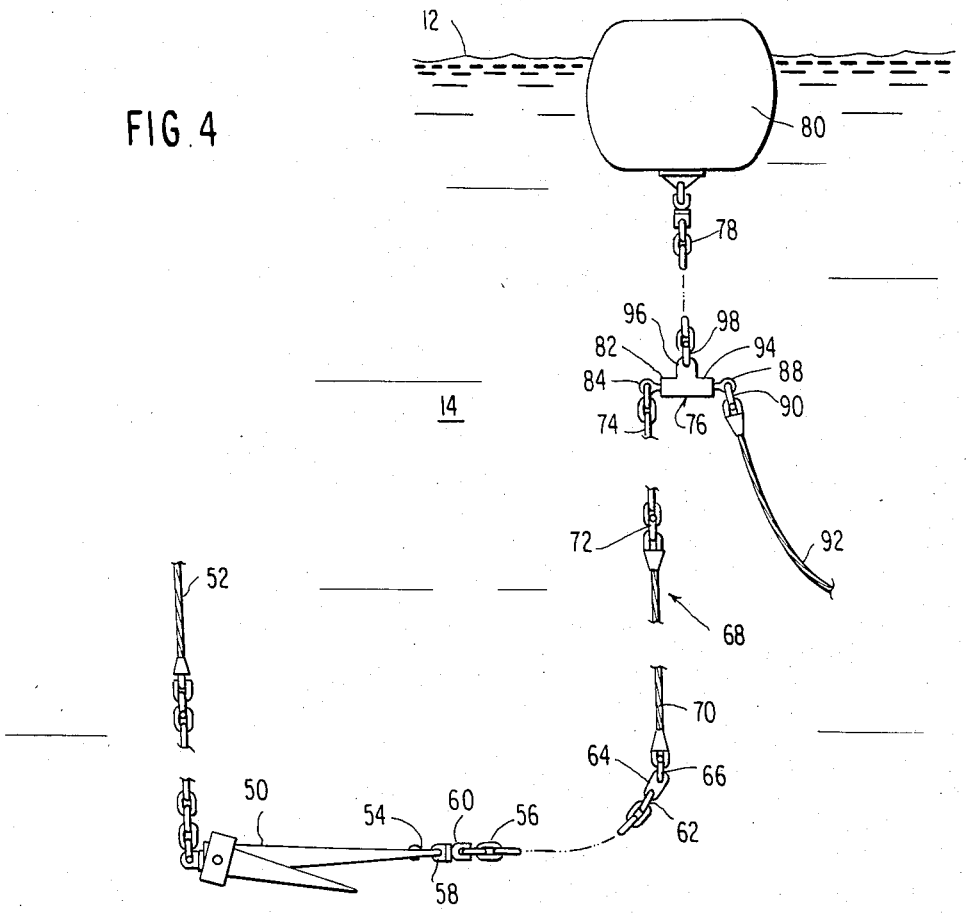
FIG. 4 is a side elevational view of one mooring unit of a turret moored drillship in accordance with a preferred embodiment of the invention.
Figure 5A:
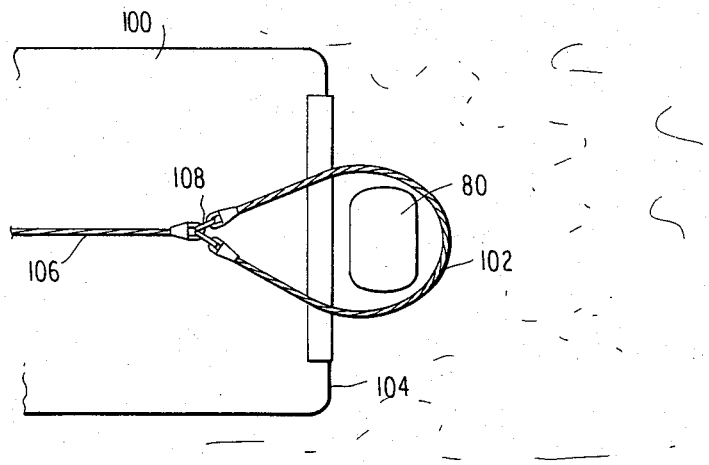
Figure 5B:
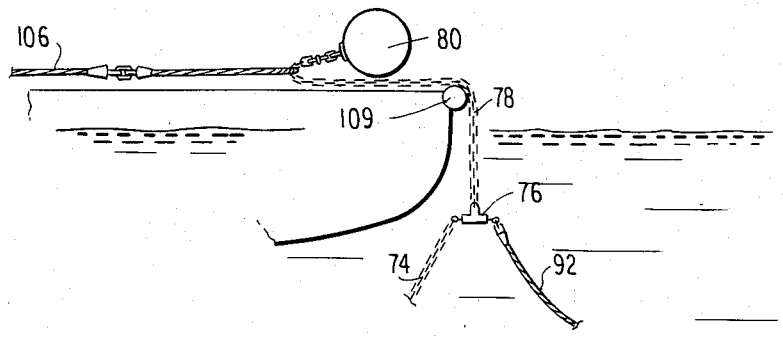
Figure 5C:
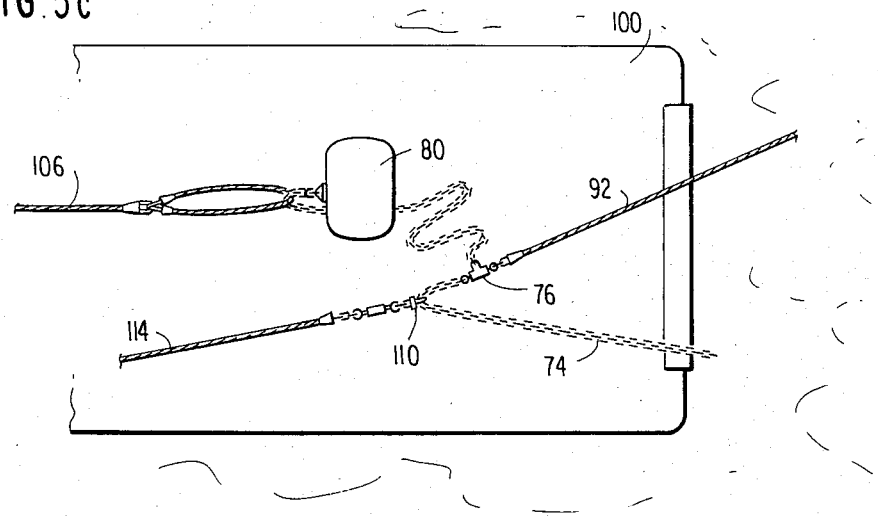
Figure 5D:
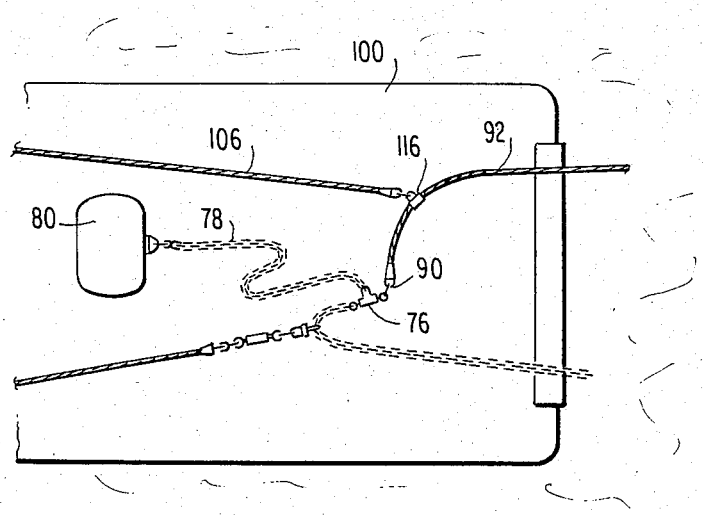
Figure 5E:
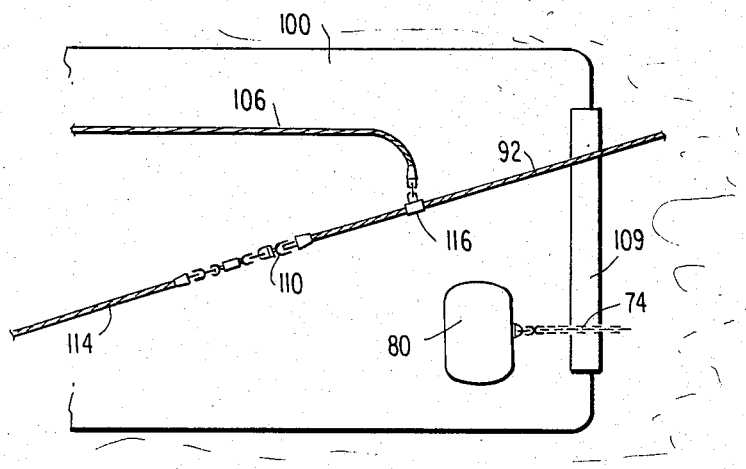
Figure 5F:
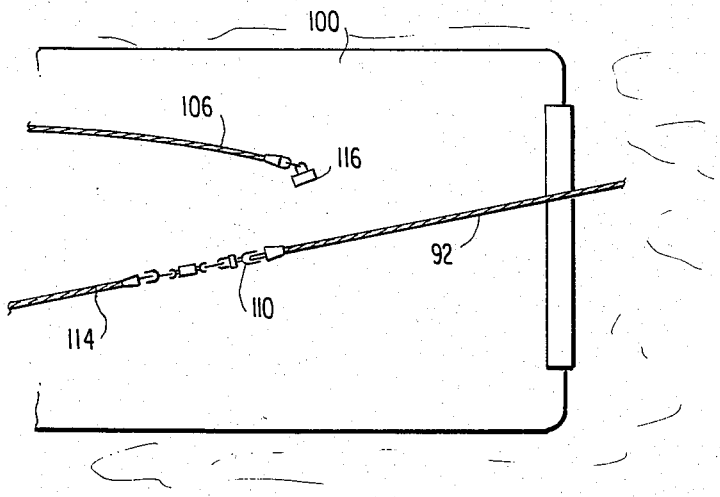
Figure 6A:
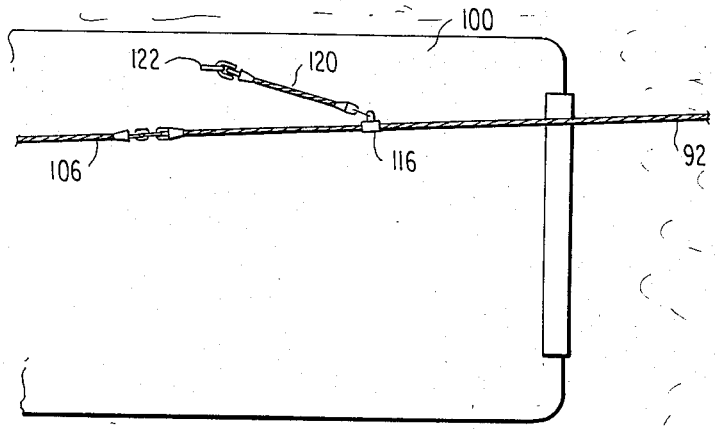
Figure 6B:
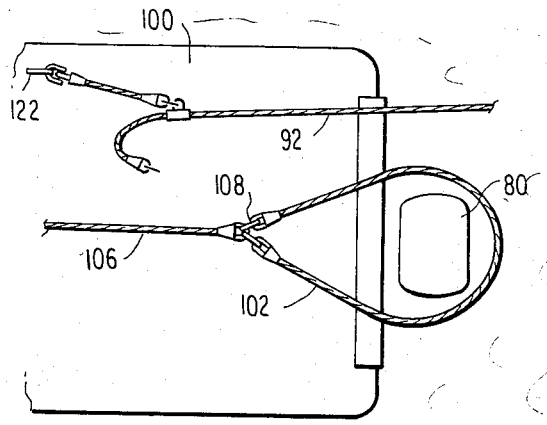
Figure 6C:
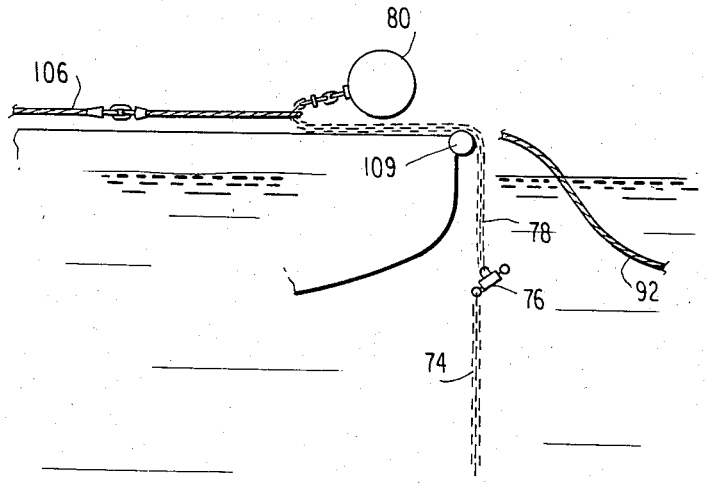
Figure 6D:
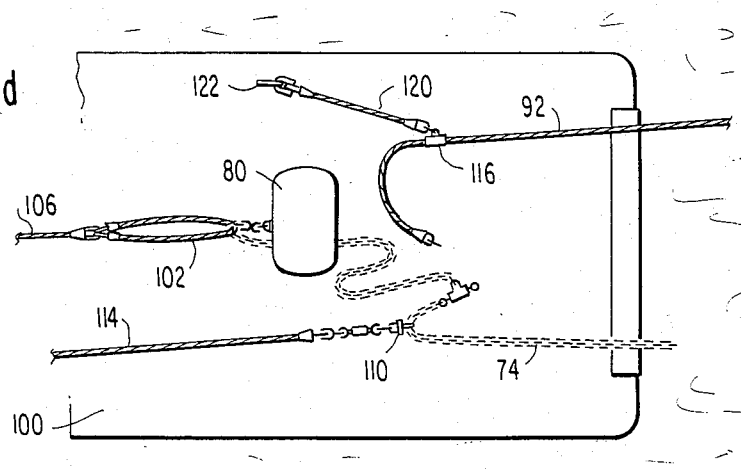
Figure 6E:
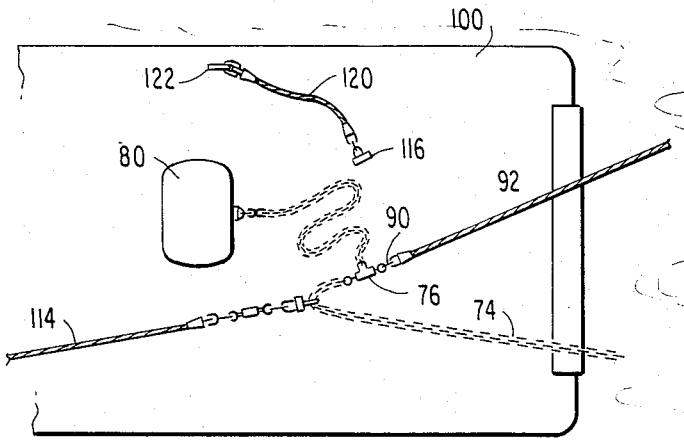
Figure 6F:
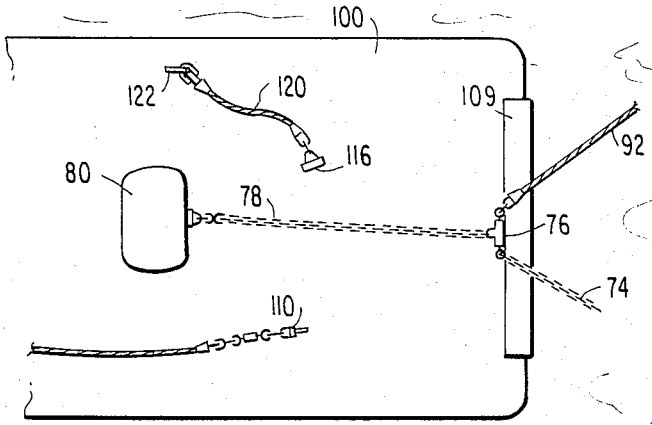
Figure 7A:
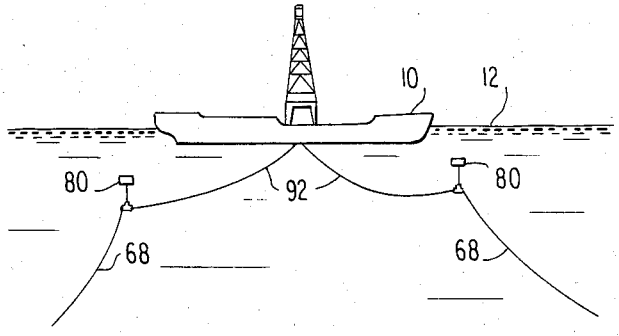
Figure 7B:
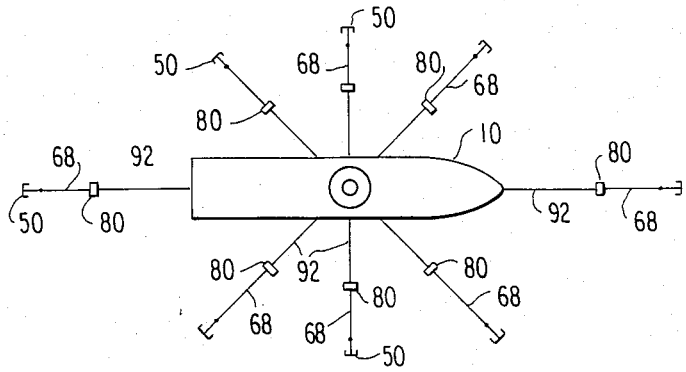
Figure 7C:
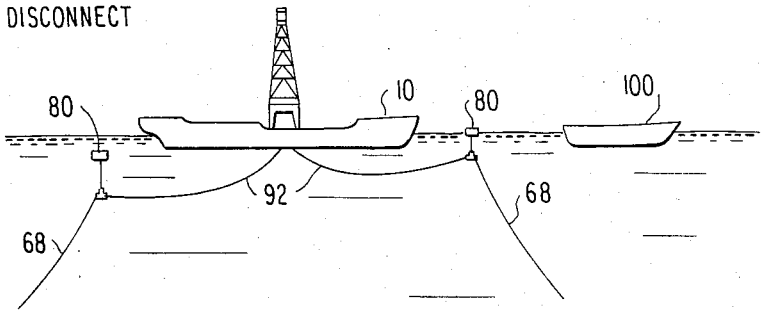
Figure 7D:
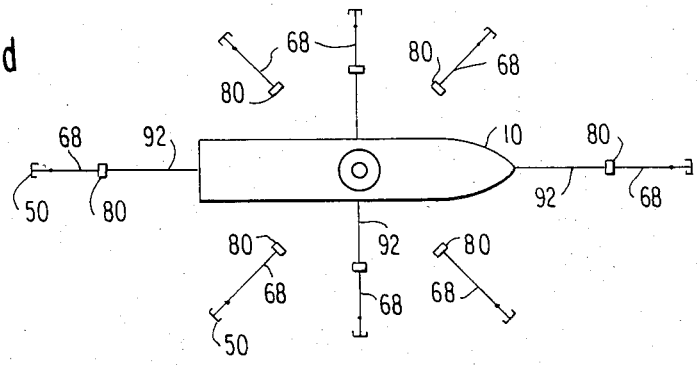
Figure 7E:
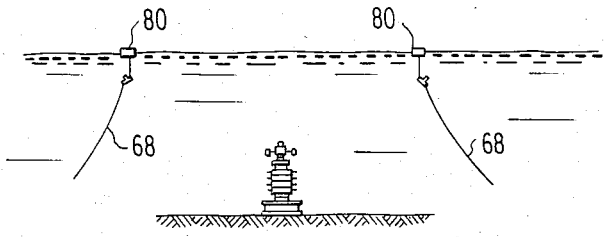
Figure 7F:
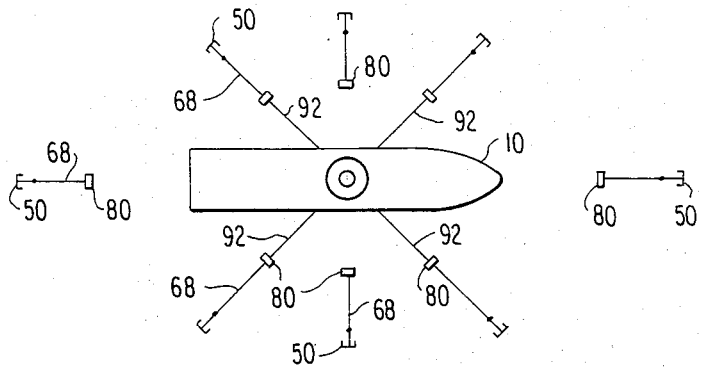
Figure 7G:
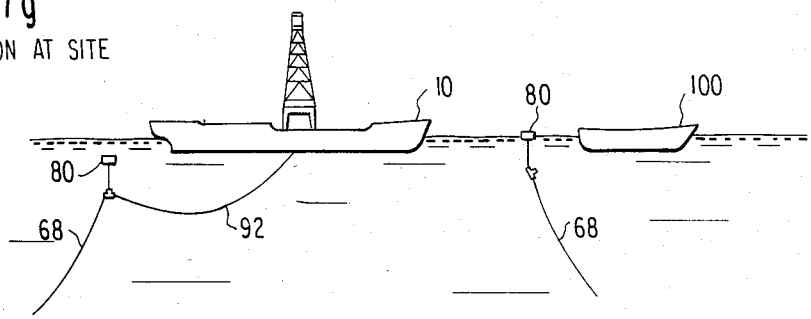
Figure 7H:
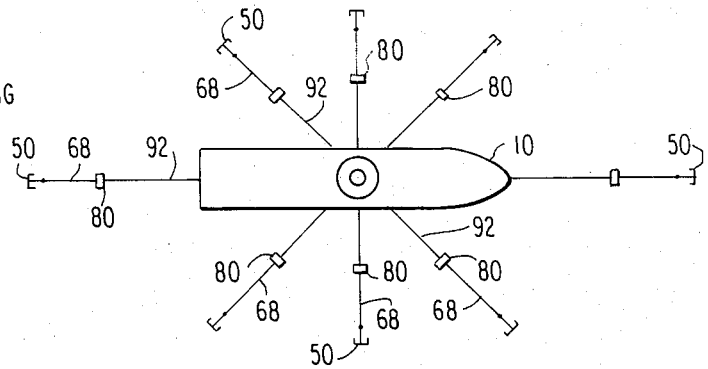

Referring now to FIG. 4, there will be seen a detailed cross-sectional view of one preferred embodiment of the invention. An anchor 50 of the type previously disclosed in the above-noted Richardson U.S. Pat. No. 3,279,404 (at FIG. 13 therein) includes a pendant line 52 and a surface buoy (not shown) for identifying the location of the anchor 50 and for use in releasing the anchor upon completion of drilling operations. A forward portion of the anchor 50 carries a shackle 54 and the anchor 50 is connected to an anchor chain 56 through a connecting link 58 and swivel 60.

The anchor chain 56 extends along the seabed, and provides weight and abrasion resistance to the mooring line as is well known in the art. A terminating link 62 is provided at a forward end of the anchor chain 56 and operably connects the chain to a connecting link 64 which, in turn, is connected by a D-clamp 66 to a first mooring line 68. The first mooring line 68 includes a wire rope 70 extending upwardly through the body of water 14 for several hundred feet and terminates at its upper end with a D-clamp connector 72 and the mooring chain 74. Both the mooring wire rope 68 and mooring chain 74 are shown in a broken condition for convenience of illustration, however, it should be noted that the mooring wire rope 70 is substantially longer than the mooring chain 74. One operative example of a first mooring line comprises a wire rope of three-inch diameter having a length of approximately 4,500 feet and a 2½-inch mooring chain having an overall length of 30 feet.

An upper portion of the mooring chain 74 is connected to a swivel tri-plate, 76 and then to a lower portion of a buoy chain 78 and a submersible buoy 80. In the view disclosed in FIG. 4, the buoy is operably floating upon the surface 12 of the body of water 14.

The buoy 80 may be composed of a spherical or cylindrical chamber with hemispherical ends. Moreover, the buoy 80 may be internally baffled for strength considerations and may be further fitted with ballast and deballast apparatus such that ballast of the buoy may be selectively controlled.

The swivel tri-plate 76 is composed of a bar number 82 pivotally connected at one end 84 to the upper end of the mooring chain 74 and pivotally connected at the other end 88 via a universal D-clamp 90 to a second mooring line 92.

The bar number 82 may be rectangular or circular in cross-section but if rectangular is surrounded by a circular bearing at each end to pivotally receive an exterior cylindrical sleeve 94 which is free to pivot or swivel about the longitudinal axis of the bar member. An external arm 96 extends outwardly from the sleeve at a right angle and is pivotally connected by a D-clamp 98 to the buoy chain 78.

Disconnect Sequence

Turning now to the sequence depicted in FIGS. *5a–5f*, there will be seen a general arrangement of operations for a quick disconnection of a mooring unit from a drillship in accordance with a preferred embodiment of the invention.

FIG. *5a* discloses a mooring system handling vessel 100 which has been maneuvered to a position adjacent a floating buoy 80. This floating posture of the buoy 80 was achieved as indicated above, by releasing tension on the second mooring line 92 from the drillship and thereby permitting the submerged buoy 80 to rise to the surface of the body of water (note the phantom line representation in FIG. 3, line (B). The submersible buoy floating on the surface of the body of water is then engaged in a wire rope bridle 102 which is looped around the buoy from the stern 104 of the workboat. The loop is connected to a 2½ inch wire rope 106 by a pair of chain shackles 108. The wire rope 106, in turn, is wound around a drum winch mounted upon the deck of the mooring system handling vessel.

By reference to FIG. *5b*, it will be seen that tensioning of the wire rope 106 by the deck winch will serve to drag the buoy 80 and the connected buoy chain 78 over a stern roller 109 of the workboat 100 and into a resting position upon the deck. As the buoy and buoy chain are pulled onto the workboard, the swivel tri-plate *7b* and the first mooring line chain 74 and the second mooring line 92 are pulled upwardly toward the boat.

As seen in FIG. *5c*, the mooring line chain 74, second mooring line 92 and the swivel tri-plate 76 have all been pulled onto the deck of the workboat 100 by tensioning cable 106. The pelican hook 110 is then connected to the mooring line chain 74 and tensioned via a wire rope 114 and a second deck mounted winch (not shown). A pelican hook is of a type which may be facilely connected to the chain portion 74 of the first mooring line and subsequently released under tension.

Turning now to FIG. *5d*, the second mooring line 92 is secured by a carpenter stop 116, and the first wire cable 106 is then connected to the carpenter stop and tensioned by the first deck mounted winch to tension the second mooring line 92 and release tension between the second mooring line and the swivel tri-plate 76. In this position, the first 68 and second 92 mooring lines are firmly secured to the mooring system handling vessel 100. Since tension has been released from the ends of the first and second mooring lines, the second mooring line may be facilely released from the tri-plate on the deck of the workboat 100 by disassembly of D-clamp 90. Upon release of the D-clamp 90, the pelican hook is released and the buoy 80 slides over the stern roller 109, into the body of water, as noted in FIG. *5e*.

The second cable 114 and the pelican hook 110 are then connected to the free end of the second mooring line 92 and tensioned from the second deck winch. The first deck winch is released and slack is taken in the first cable 106 so that the carpenter stop 116 can be released as depicted in FIG. *5f*. The pelican hook 110 is then released, under tension, and the second mooring line 92 is drawn back onto the drillship through the turret.

Following the above disconnection procedure the first mooring line 68, including the wire cable 70 and mooring chain 74 remains connected to the tri-plate 76 and the buoy 80 floats upon the surface of the body of water in a position to be facilely picked up by a workboat such that the second mooring line 92 may be readily reconnected with the mooring system.

In some instances where a very rapid disconnect procedure is dictated, the second mooring line 92 may be cut or severed adjacent the buoy 80 or at the drillship to permit immediate release of the mooring system to run from a storm.

Connection Sequence

Turning now to the sequence of views depicted in FIGS. *6a–6f*, there will be seen a method of reconnecting a mooring line in accordance with a preferred embodiment of the invention. As seen in FIG. *6a*, an initial step in reconnecting the mooring system involves attaching a free end of the second mooring line 92 to a wire rope 106 and pulling the line onto the deck of the workboat 100. A carpenter stop 116, is then attached to the second mooring line 92 and secured, via a sling 120, to a pad eye 122 mounted upon the deck of the workboat 100.

Once the second mooring line 92 is securely attached to the workboat 100, the wire rope 106 is released from the end of mooring line 92 and reconnected via chain shackles 108 to the wire line bridal 102.

As shown in FIG. *6b*, the wire line bridle is then thrown over the stern of the workboat and around the buoy 80. The submersible buoy 80 is pulled onto the deck of the workboat over the stern roller 109 by tensioning of the wirerope 106 around the first deck winch. As the buoy 80 is pulled on board, the buoy chain 78, swivel tri-plated 76 and mooring line chain 74 will be drawn onto the workboat as illustrated in FIGS. *6c* and *6d*. A second wire rope 114, carrying a pelican hook 110 is then connected to the mooring chain portion 74 of the first mooring line 68 and tensioned. Tension is then released on the first line 106 and the bridle 102 can be removed from connection with buoy 80. The swivel tri-plate 76 is then reconnected to the free end of the second mooring line 92 by attachment of a universal D-clamp 90.

As seen in FIG. *6e*, tension from line 114 is then distributed equally between the mooring line chain 74 and the second mooring line 92 to release tension on the carpenter stop. The stop is removed from its connection with the second mooring line 92 and the pelican hook 110 is then released. The first and second mooring lines, anchor chain 78 and buoy 80 are thus freed to slide over the stern roller 109 and into the body of water. Once the submersible buoy and the connecting ends of the first and second mooring lines are released from the work vessel, they will be in a position such as depicted by phantom lines (B) in FIG. 3. Tension is then taken up on the drillship winches 32 and the submersible buoy 80 is drawn into the body of water into a secure mooring posture as shown in solid lines (A) of FIG. 3.

Sequence of Partial Disconnect/Connect

Turning now to the sequence depicted in FIG. *7a–7b*, there will be seen an operational sequence for quickly disconnecting a mooring system from an operating drillship in stages such that partial disconnection may be achieved to determine if an impending environmental hazard is actually going to pass close enough to the operating drillship to require the drillship to move off station. In the event, that it is advisable for the drillship to be completely disconnected from its mooring, the intermediate or temporary disconnection procedure may be rapidly and facilely completed so that the drillship can move off station and then upon passage of the hazard, be quickly reconnected for continued operations. Alternatively, if it is determined that the environmental hazard has changed course and thus, does not dictate shutdown of drilling operations, the partially disconnection mooring system may be facilely reconnected without a lengthly interruption in drilling operations.

With reference now to FIG. *7a*, there will be seen a drillship 10 positioned upon the surface 12 of a body of water and being held on station by a turret mooring system. The mooring system includes a plurality of mooring units each comprising a first mooring line 68 and a second mooring line 92 which are coupled to a submersible buoy 80 in a manner as discussed in detail in connection with FIG. 4. In a side elevational view of the drillship, note FIG. *7a*, only the buoy and stern mooring units are shown. In an operating system however, and with reference to FIG. *7b*, a drillship 10 is preferably secured by a set of eight mooring units which radiate away from the drillship mooring turret at equally spaced angles of 45 degrees with respect to each other to form a uniform system. In the posture depicted in FIG. *7b*, the drillship 10 is secured and free to pivot about its mooring turret to maintain heading into the environmental forces by operation of retractable thrusters as discussed above.

Turning to FIG. *7c*, in some instances of drilling operations when an environmental hazard is detected as having a path in alignment with the drillship the mooring system may be is tentatively released by releasing tension on the second mooring line 92 with respect to alternate mooring units. The submersible buoy 80 of each mooring unit will then float to the surface and the second mooring lines 92 can be released from the buoys 80 with the assistance of a mooring system handling vessel 100 via the procedure as discussed in detail above with respect to FIGS. *5a–5f*.

Referring now to FIG. *7d*, alternate mooring units are disconnected from the ship turret and the second mooring lines 92 are drawn onto the deck winches of drillship 10. The first mooring lines 68 of the disconnected mooring units are maintained in a suspended position between anchor 50 and submersible buoy 80. In this posture of partial mooring, drilling is continued until it is determined that the previously forecasted environmental hazard is indeed going to pass through the path of the operating drillship. Such determinations can be made by receiving satellite tracking of storm movement or radar monitoring techniques available on ocean going vessels. If it is determined that indeed the environmental hazard is going to pass through the drill site, the remaining four mooring units may be facilely disconnected as discussed with respect to FIGS. *5a–5f* and the vessel can then be navigated to a safe location while the first mooring lines 68 and supporting buoys 80 remain on station as depicted in FIG. *7e*.

Upon passage of the environmental hazard the drillship is navigated back to the worksite and four of the mooring units are quickly connected to the drillship by the procedure outlined in connection with FIGS. *6a–6f*. Drilling oprations may then be quickly re-established with only the four mooring units in place.

As shown in FIGS. *7g* and *7h* full mooring may then be achieved by connecting the alternate four units from a workboat 100 to re-establish a complete set of eight fully tensioned mooring lines for continued operations.

SUMMARY OF MAJOR ADVANTAGES OF THE INVENTION

After reading and understanding the foregoing description of the invention, in conjunction with the drawings, it will be appreciated that several distinct advantages of the subject quick-disconnect/connect mooring system for a turret moored drillship are obtained.

Without attempting to set forth all of the desirable features of the instant quick-disconnect/connect mooring system, at least some of the major advantages of the invention include the unique combination of a submersible buoy 80 in cooperation with a first mooring line 68, having a relatively short mooring claim segment and a second mooring line 92. This combination provides a relatively light-weight yet rugged and easily handled mooring system which can be disconnected between the first mooring line and the second mooring line and then quickly reconnected.

The submersible buoy 80 forms the mooring system into a double catenary and upon slacking of the upper mooring line 92 from the drillship the buoy 80 raises to the surface of the body of water for a quick yet reliable disconnect/connect procedure. The disconnect/connect procedure as shown in FIGS. *5a–5f* and FIGS. *6a–6f* provides an easily controlled procedure which may be performed from the deck of a workboat with mechanical equipment familiar to deckhands working in the offshore industry.

The mooring chain segment-A of the first mooring line 68 permits quick connection and release by a pelican hook as discussed above and facilitates handling of mooring unit on a work boat.

The swivel tri-plate 76 permits facile handling of the submersible buoy 80 and torque free tensioning of the mooring unit.

The disconnection/connect sequence enables a mooring unit to be quickly handled to avoid drilling down time from mooring considerations. The partial disconnect procedure allows a drillship operator to delay a decision to "run" from a storm or iceberg. Moreover, upon return, the floating buoys permit a quick connection of four mooring units and a resumption of operations while full mooring is established.

In describing the invention, reference has been made to a preferred embodiment and illustrative advantages of the invention. Those skilled in the art, however, and familiar with the instant disclosure of the subject invention, may recognize additions, deletions, modifications, substitutions, and/or other changes which will fall within the purview of the subject invention and claims.

We claim:

1. A disconnect/connect mooring system for a turret moored drillship comprising:

an anchor for releasably engaging the bed of a body of water;

a first mooring line connected at one end to said anchor, said first mooring line including a length of wire rope operably connected at one end to said anchor and extending upwardly within the body of water, and a mooring line chain connected at one end to the other end of said length of wire rope at a location remote from said anchor, said mooring line chain having a length substantially less than the length of said wire rope;

a submersible buoy connected to said mooring line chain and having a buoyancy sufficient to float with said length of wire rope and said mooring line chain of said first mooring line suspended from said submersible buoy; and a second mooring line operably connected to said first mooring line and extending to the turret moored drillship such that upon tensioning of said second mooring line from said drillship said submersible buoy will be drawn into the body of water and said first mooring line will form a first catenary between said anchor and the submerged buoy and said second mooring line will form a second catenary between said submerged buoy and the turret moored drillship and upon release of said second mooring line from operable connection with said first mooring line said buoy will float on the surface of the body of water carrying said first mooring line, wherein said turret moored drillship may be facilely disconnected and connected from said mooring system.

2. A disconnect/connect mooring system for a turret moored drillship as defined in claim 1 and further comprising:

a buoy chain operably connected at one end to the other end of said mooring line chain and at the other end to said submersible buoy.

3. A disconnect/connect mooring system for a turret moored drillship as defined in claim 2 and further comprising:

a tri-plate having opposing arms connected in series between the other end of said mooring line chain and said second mooring line and a third arm normal to said opposing arms and being connected to said buoy chain.

4. A disconnect/connect mooring system for a turret moored drillship as defined in claim 3 wherein:

said opposing arm comprised a linear bar member; and said third arm is mounted upon a sleeve pivotally carried in a coaxial posture about said bar member and operably being free to pivot about said bar such that said third arm is free to swivel with respect to said bar member.

5. A disconnect/connect mooring system for a turret moored drillship as defined in claim 3 or 4 and further comprising:

universal release means coupling said second mooring line and said tri-plate arm.

6. A disconnect/connect mooring system for a turret moored drillship as defined in claim 2 or 4 and further comprising:

swivel means connected between said submersible buoy and the other end of said buoy chain.

7. A disconnect/connect mooring system for a turret moored drillship as defined in claim 2 or 4 wherein:

said second mooring line comprises a wire rope extending from said submersible buoy to the drillship.

8. A disconnect/connect mooring system for a drilling vessel comprising:

an anchor for releasably engaging the bed of a body of water;

a first mooring line connected at one end to said anchor, said first mooring line including a length of wire rope operably connected at one end to said anchor and extending upwardly within the body of water, and a mooring line chain connected at one end to the other end of said length of wire rope at a location remote from said anchor, said mooring line chain having a length substantially less than the length of said wire rope;

a submersible buoy having a buoyancy sufficient to float with said first mooring line suspending from said submersible buoy;

a buoy chain having one end connected to said submersible buoy and the other end connected to said first mooring line;

a swivel tri-plate having a first portion pivotally connected to the other end of said mooring line chain and a second portion pivotally connected to the other end of said buoy chain; and a second mooring line connected at one end to a third portion of said swivel tri-plate and extending to the drilling vessel such that upon tensioning of said second mooring line from said drilling vessel said submersible buoy will be drawn into the body of water and said first mooring line will form a first catenary between said anchor and the submerged buoy and said second mooring line will form a second catenary between said submerged buoy and the drilling vessel and upon release of said second mooring line from operable connection with said swivel tri-plate said buoy will float on the surface of the body of water carrying said first mooring line, wherein said drilling vessel may be facilely disconnected and connected from said mooring system.

9. A disconnect/connect mooring system for a drilling vessel as defined in claim 8 wherein:

said second mooring line comprises a wire rope extending from said swivel tri-plate to the drilling vessel.

10. A disconnect/connect mooring system for a drilling vessel as defined in claim 8 and further comprising:

swivel means connected between said submersible buoy and said one end of said buoy chain.

11. A disconnect/connect mooring system for a drilling vessel as defined in claim 8 and further comprising:

universal release means coupling said second mooring line and said tri-plate.

12. A disconnect/connect mooring system for a drilling vessel as defined in claim 8 wherein said swivel tri-plate comprises:

a linear bar member pivotally connected at one end to the other end of said mooring line chain and pivotally connected at the other end to said second mooring line;

a sleeve coaxially and rotatably mounted about said linear bar member; and an external arm normally connected to said sleeve at one end and pivotally connected to the other end of said buoy chain wherein said buoy chain may operably swivel with respect to said mooring line chain of said first mooring line and said second mooring line.

13. A method for disconnecting a turret moored drillship from a mooring system comprising an anchor, a submersible buoy, a first mooring line extending in a catenary between the anchor and the submersible buoy in a submerged posture, and a second mooring line extending in a catenary between the submerged buoy and the turret moored drillship, said method comprising the steps of:

releasing tension on the second mooring line from the drillship and thereby permitting the submerged buoy to rise to the surface of a body of water;

engaging the submersible buoy floating on the surface of the body of water from a mooring system handling vessel;

pulling the submersible buoy and the connecting ends of the first and second mooring lines onto the mooring system handling vessel;

securing each of the connecting ends of the first and second mooring lines to the mooring system handling vessel;

releasing the second mooring line from connection with the submersible buoy;

releasing the submersible buoy from the mooring system handling vessel into floating support of the first mooring line between the surface of the body of water and the anchor; and retrieving the second mooring line onto the turret moored drillship.

14. A method for disconnecting a turret moored drillship from a mooring system as defined in claim 13 wherein the first mooring line includes a wire rope and a relatively short segment of mooring line chain connected to the wire rope at a location remote from the anchor and adjacent to the submersible buoy and said step of securing each of the ends of the first and second mooring lines comprising:

connecting a releasable hook to the relatively short segment of mooring chain and tensioning said first mooring line from the deck of the mooring system handling vessel; and connecting a line to the second mooring line and tensioning the second mooring line from the deck of the mooring system handling vessel to release tension on the coupling between the first and second mooring lines.

15. A method for disconnecting a turret moored drillship from a mooring system as defined in claim 14 wherein the first mooring line is connected to the second mooring line by a swivel tri-plate and said step of releasing the second mooring line comprises:

releasing a universal connection between the second mooring line on deck of the mooring system handling vessel and the swivel tri-plate.

16. A method for connecting a turret moored drillship to a mooring system comprising an anchor, a submersible buoy, and a first mooring line extending in a catenary between the anchor and the submersible buoy, said method comprising the steps of:

attaching a second mooring line from the drillship to the deck of a mooring system handling vessel;

engaging the submersible buoy floating on the surface of the body of water from the mooring system handling vessel;

pulling the submersible buoy and the connecting end of the first mooring line onto the mooring system handling vessel;

attaching a connecting end of the second mooring line onto the first mooring line;

releasing the submersible buoy and the connecting ends of the first and second mooring lines onto the surface of the body of water; and tensioning the second mooring line from the drillship and thereby pulling the submersible buoy into a submerged posture and forming a first catenary between the anchor and the submerged buoy and a second catenary between the submerged buoy and the drillship.

17. A method for connecting a turret moored drillship to a mooring system as defined in claim 16 wherein the first mooring line is connected to the second mooring line by a swivel tri-plate and said step of attaching the second mooring line comprises:

connecting a universal coupling between the connecting end of the second mooring line and the swivel tri-plate.

18. A method for partially disconnecting a turret moored drillship from a mooring system comprising a series of eight mooring units radially splayed outwardly and downwardly in a uniform radial pattern from a turret of the drillship wherein each mooring unit comprises an anchor, a submersible buoy, a first mooring line extending in a caternary between the anchor and the submersible buoy in a submerged posture, and a second mooring line extending in a catenary between the submerged buoy and the drillship turret, said method comprising the steps of:

partially releasing the mooring system of a turret moored drillship by:

(a) releasing tension on the second mooring line of each alternate mooring units from the drillship and thereby permitting the submerged buoy of alternate mooring units to rise to the surface of a body of water;

(b) for each alternate mooring unit engaging the submersible buoy floating on the surface of the body of water by a mooring system handling vessel;

(c) for each alternate mooring unit, pulling the submersible buoy and the connecting ends of the first and second mooring lines onto a mooring system handling vessel;

(d) for each alternate mooring unit, securing each of the connecting ends of the first and second mooring lines to the mooring system handling vessel;

(e) for each alternate mooring unit, releasing the second mooring line from connection with the submersible buoy;

(f) for each alternate mooring unit, releasing the submersible buoy from the mooring system handling vessel into floating support of the first mooring line; and (g) for each alternate mooring unit, retrieving the second mooring line onto the turret moored drillship.

19. A method as defined in claim 18 and further comprising the steps of:

reconnecting each of the alternate mooring units disconnected from the drillship by the steps for each such mooring unit:

(a) attaching the second mooring line from the drillship to the deck of a mooring system handling vessel;

(b) engaging the submersible buoy floating on the surface of the body of water from the mooring system handling vessel;

(c) pulling the submersible buoy and the connecting end of the first mooring line onto the mooring system handling vessel;

(d) attaching a connecting end of the second mooring line onto the first mooring line;

(e) releasing the submersible buoy and the connecting ends of the first and second mooring lines onto the surface of the body of water; and (f) tensioning the second mooring line from the drillship and thereby pulling the submersible buoy into a submerged posture and forming a first catenary between the anchor and the submerged buoy and the drillship.

20. A method as defined in claim 18 and further comprising the steps of:

completely disconnecting the drillship from the mooring system by repeating substeps (a) through (g) for each mooring unit still connected to the turret of the drillship.

* * * * *